US007355117B2

(12) United States Patent
Castaldo et al.

(10) Patent No.: US 7,355,117 B2
(45) Date of Patent: Apr. 8, 2008

(54) TAMPER-RESISTANT ELECTRICAL WIRING DEVICE SYSTEM

(75) Inventors: Cosmo Castaldo, Westbury, NY (US); Azer Ilkhanov, Brooklyn, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/470,995

(22) Filed: Sep. 7, 2006

(65) Prior Publication Data

US 2007/0114053 A1 May 24, 2007

Related U.S. Application Data

(60) Provisional application No. 60/715,081, filed on Sep. 8, 2005.

(51) Int. Cl.
*H01R 13/46* (2006.01)

(52) U.S. Cl. ..... 174/53; 174/58; 174/66; 439/145

(58) Field of Classification Search ..... 174/66, 174/67, 53, 58; 439/139, 135, 136, 143, 439/145, 142; 335/18
See application file for complete search history.

(56) References Cited

U.S. PATENT DOCUMENTS 4,603,932 A * 8/1986 Heverly ..... 439/147
4,867,693 A 9/1989 Gizienski et al.
4,867,694 A 9/1989 Short
4,897,049 A * 1/1990 Miller et al. ..... 439/365
4,936,789 A * 6/1990 Ugalde ..... 439/236
5,006,075 A 4/1991 Bowden, Jr.
5,518,132 A 5/1996 Chen
5,702,259 A 12/1997 Lee
5,839,909 A * 11/1998 Calderara et al. ..... 439/137
5,902,140 A * 5/1999 Cheung et al. ..... 439/139
5,915,981 A 6/1999 Mehta
6,086,391 A 7/2000 Chiu
6,149,446 A 11/2000 Yu
6,217,353 B1 4/2001 Yu-Tse
6,224,401 B1 5/2001 Yu
6,238,224 B1 5/2001 Shao
6,422,880 B1 7/2002 Chiu
6,537,088 B2 * 3/2003 Huang ..... 439/137
6,767,228 B2 7/2004 Katz
6,969,801 B2 11/2005 Radosavljevic et al.
7,179,992 B1 * 2/2007 Packard et al. ..... 174/53

* cited by examiner

*Primary Examiner*—Dhiru R. Patel
(74) *Attorney, Agent, or Firm*—Paul J. Sutton

(57) ABSTRACT

A tamper-resistant electrical receptacle disclosed herein includes a cover assembly having at least one pair of apertures, a cover, and at least one slider that rests in the cover behind one pair of the apertures. The slider is held in a first position where it covers both apertures such that an object is blocked from entrance in either aperture and, thereby, blocked from accessing either receptacle terminal formed in the base assembly connected to the cover assembly. This first position is maintained until prongs are substantially inserted simultaneously into the apertures causing the slider to move into a second position where the prongs are enabled to pass through the apertures, engaging the receptacle terminals. After the prongs are removed from the receptacle terminals, the slider automatically retracts to the first position. When only one aperture is probed by an object, however, the slider remains confined in the first position.

9 Claims, 14 Drawing Sheets

FIG. 8
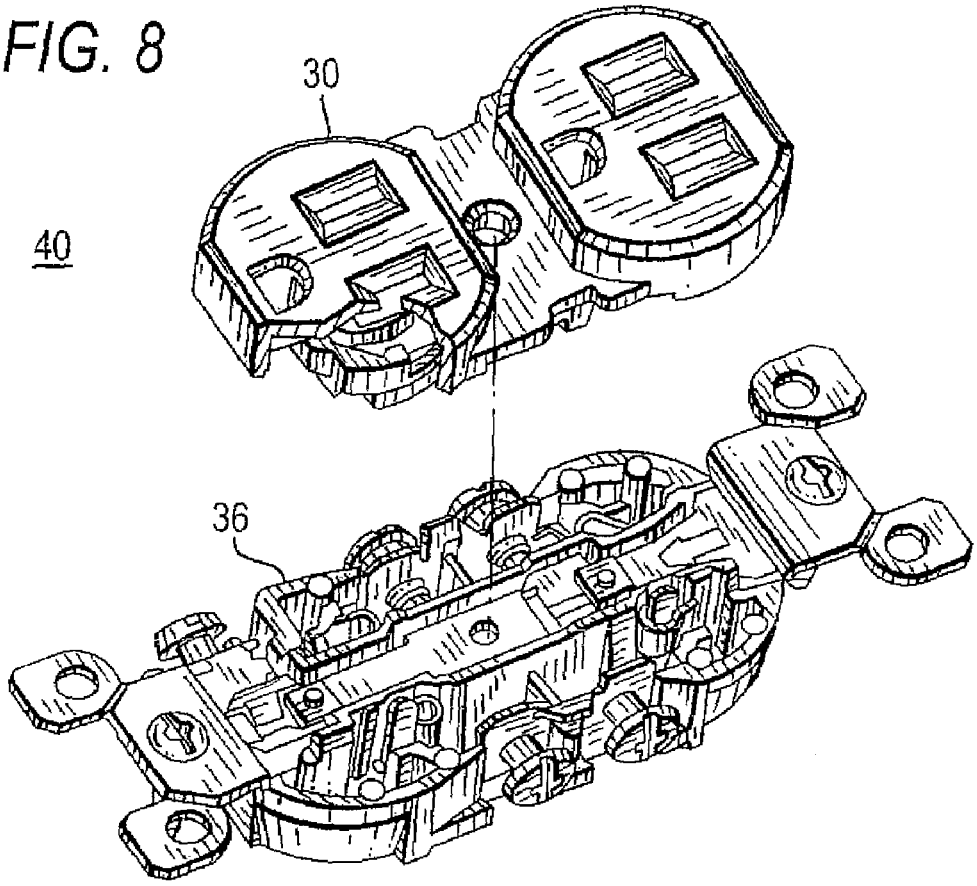
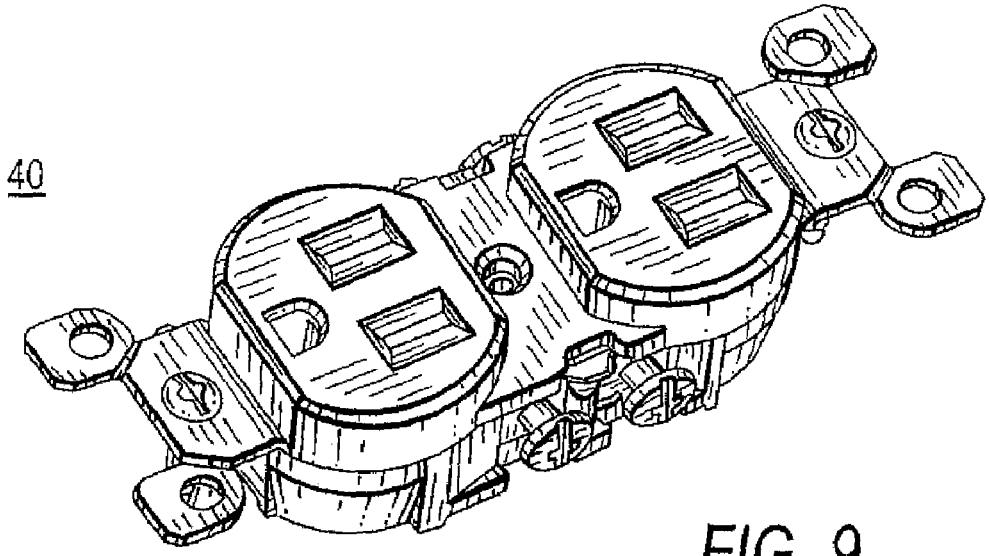
FIG. 9

TAMPER-RESISTANT ELECTRICAL WIRING DEVICE SYSTEM

This application claims the benefit of the filing date of a provisional application having application Ser. No. 60/715,081, which was filed on Sep. 8, 2005.

FIELD OF THE INVENTION

The present invention relates to electrical receptacles, and, more particularly, to a tamper-resistant electrical wiring device system.

BACKGROUND OF THE INVENTION

Electrical power transmitted from a source to a point of use through an electrical distribution system within a home or a commercial building for equipment and operations is a beneficial service. Conventional electrical receptacles within such a distribution system include a pair of slots or apertures aligned with contacts, wherein prongs of an electric plug may be inserted in the pair of apertures to directly engage contacts within the receptacle in an effort to facilitate a desired electrical connection. Since a large percentage of these receptacles are used in residential buildings and are located near the floor, a young child or infant, for example, may insert a small object into either one of the apertures which potentially may result in electrical shock. More particularly, a burn or shock may result when a child's wet mouth enables electrical contact, wherein a path exists from the hot contact through the child to ground, establishing a ground fault.

Besides a child's fingers and mouth, children may insert into receptacles a wide variety of objects made of conductive material including but not limited to a metal articles. Most objects may be everyday household and easily accessible items such as, paper clips, pens wire tools, hairpins, safety pins, keys, forks, knives, screws, nails, tweezers and coins. Since some of these objects may be perceived by parents as safe, parents tend not to restrict access to many of these objects.

Both scenarios present circumstances to be avoided, where possible. As such, the issue of human safety and avoiding hazards has always been considered by the owner of the instant application in developing new products. Further, in an effort to eliminate the foregoing, the National Electrical Code (NEC) now requires tamper-proof electrical receptacles in pediatric environments since electrical shocks often occur in these types of environments. Research studies have shown that many of these incidents happen around meal time, when parents are occupied in the kitchen and children are not well supervised. A National Electrical Manufacturer's Association (NEMA) task force has concluded that every residential building should be required to have tamper-resistant electrical receptacles and ground fault circuit interrupters (GFCI) designed within the electrical distribution system throughout the home.

Presently available circuit interrupter devices, such as the device described in commonly owned U.S. Pat. No. 4,595,894, which is incorporated herein in its entirety by reference, use a trip mechanism to mechanically break an electrical connection between one or more input and output conductors. Such devices are resettable after they are tripped after the detection of a ground fault. The ground fault circuit interrupter, however, only disconnects the circuit after electrical contact is made with a conductor. Thus, without a tamper resistant electrical receptacle, a person may still experience an initial temporary shock.

Numerous child-proof devices have been proposed or are commercially available which are directed to preventing a child from touching the apertures in a receptacle assembly or preventing a child from inserting or removing an electrical plug in or from the apertures. No such device, however, has achieved wide acceptance; therefore, the aforementioned condition remains today. This is primarily due to ineffectiveness of each device, expense, and the lack of ease of use. Foremost among these drawbacks is one of expense. That is, there are conventional devices that may be applied to various receptacles with safety features. However, the added expense required to manufacture such receptacles outweighs the safety advantage.

Prior patents featuring safety electric receptacles have generally comprised attachments for the face plate of an electric receptacle featuring rotatable snap-on or sliding covers for the electric socket opening, such as disclosed by U.S. Pat. Nos. 3,639,886 and 3,656,083 in which the face plate attachments are manually moved for insertion and removal of the plug. These attachments, such as plastic receptacle caps, are generally designed to include plastic plates having a pair of wall receptacle aperture engaging blades. These plastic receptacle caps, however, are unreliable and inefficient. Research in 1997 by the Temple University Biokinetics Laboratory in Philadelphia showed that 47% of the 4 year olds in a test group were able to remove one brand of receptacle caps. For another similar embodiment of an receptacle cap, 100% of the children within the age group of 2 to 4 years of age were able to remove the receptacle cap in many cases in less than 10 seconds. Other disadvantages of plastic receptacle caps include but are not limited to the forgetfulness of adults to reinsert the caps. In addition, receptacles are susceptible to being exposed to a child who may pull a lamp cord, leaving the receptacle unprotected. Furthermore, constant pressure from the plastic blades on the receptacle contacts increase contact distortion, increasing the risk of loose contacts and/or creating poor contacts, resulting in plugs falling out of the receptacle. Moreover, many of the plastic receptacle caps may create choking hazards, since they may fail to pass a choke hazard test described in a UL standard.

Other patents, such as U.S. Pat. Nos. 2,552,061 and 2,610,999 feature overlying slotted slidable plates which must be manually moved to mate the overlying plate slots with the electric receptacle slots or openings for insertion and removal of the plug. Sliding shutter plates offer a better level of protection than receptacle caps. However, none of the sliding shutter plates that are on the market are UL listed. This is primarily due to the fact that they add extra layers of material between the plug prongs and the receptacle contacts which reduces the surface of contact between plug prongs and contacts, causing potential heat rise or arcing which may also be hazardous. Another disadvantage of a manually movable face plate is that a small child, by observation, may learn to expose the electric receptacle.

Thus, a need exists for an simple, effective, efficient, low-cost electrical receptacle that is tamper-proof and does not need continuous manual adjustment. This device must prevent electric shock when one inserts a conductive instrumentality other than the plug of an appliance, while still permitting full surface contact between the plug prongs and contacts and frequent insertion and removal of prongs.

The present invention is directed to overcoming, or at least reducing the effects of one or more of the problems set forth above.

SUMMARY OF THE INVENTION

To address the above-discussed deficiencies of child-proof devices for electrical receptacles, the present invention teaches a tamper resistant electrical receptacle that has a simple, effective, efficient, low-cost design that does not need continuous manual adjustment. This device prevents electric shock when one inserts an object into one aperture in the cover, while still permitting the frequent insertion and removal of plugs to an electrical appliance.

Specifically, a tamper resistant electrical receptacle in accordance with the present invention includes a base assembly that connects to a cover assembly, wherein the cover assembly having at least one pair of cover apertures, includes a slider positioned in a first position to block entry into the cover assembly when an object is inserted into only one cover aperture (the typical scenario for children probing electrical receptacles). When, however, a pair of prongs are inserted into the electrical receptacle, the slider shifts out of the way into a second position that enables the pair of prongs to engage the receptacle terminals located in the base assembly. Access to the receptacle terminals is thus prevented significantly reducing the likelihood of electric shock due to contact with these terminals.

A first embodiment of the tamper-resistant electrical receptacle for electrical connection between an appliance having a pair of prongs and a power distribution system includes a base assembly attached to a cover assembly. The cover assembly includes a cover having at least one pair of apertures for at least one pair of prongs of an external electrical plug to be inserted therethrough. The apertures in the cover assembly align with receptacle terminals in the base assembly. The cover assembly further includes at least one slider that rests in the cover behind one pair of the apertures. The slider is held in a first position wherein the slider covers both apertures of the cover such that an object is blocked from entering into either of the pair of apertures in the cover and, thereby, prevents access to the receptacle terminals. The slider is restricted to the first position when an object probes only one aperture in the cover. This first position is maintained until a pair of prongs are inserted into the pair of apertures causing the slider to slide into a second position allowing the pair of prongs to pass through the pair of apertures in the cover and enabling each prong to engage a respective one of the receptacle terminals. In this second position, the width of the slider is selected such that when the slider moves into this position the aperture covers are no longer covered and blocked by the slider. Thus, the receptacle terminals are fully accessible to the pair of prongs in the second position. After the pair of prongs are removed from the receptacle terminals, the slider automatically retracts to the first position where access to the receptacle terminals is blocked.

Another embodiment of the tamper-resistant electrical receptacle for electrical connection between an appliance and a power distribution system includes a base assembly attached to a cover assembly, wherein the apertures in the cover assembly align with the receptacle terminals in the base assembly. The cover assembly includes a cover having at least one pair of apertures for at least one pair of prongs of an external electrical plug to be inserted therethrough. The cover assembly further includes at least one platform sub-assembly, wherein each platform sub-assembly rests in the cover behind one pair of the apertures. The platform sub-assembly includes a slider, a platform, and a leaf spring. The slider rests in the platform and is held into position by a leaf spring that is in juxtaposition with the slider.

The leaf spring is used to load the slider in a first position where the slider covers both apertures in the cover such that an object is blocked from entrance into either of the pair of apertures in the cover. The leaf spring, the platform and the cover confine the slider in the first position when an object probes only one aperture in the cover. This first position is maintained until the pair of prongs are inserted into the pair of apertures causing the slider to slide into a second position allowing the pair of prongs to pass through the pair of apertures in the cover so that each prong engages a respective one of the receptacle terminals. In this second position, the slider is designed to be just wide enough to allow the receptacle prongs access to the pair of prongs. After the pair of prongs are removed from the receptacle terminals, the leaf spring automatically retracts the slider to the first position, in which access to the receptacle terminals is blocked.

Another embodiment of the tamper-resistant electrical receptacle of the present invention includes a base assembly attached to a cover assembly, wherein the apertures in the cover assembly align with the receptacle terminals in the base assembly. The cover assembly includes a cover having at least one pair of apertures for at least one pair of prongs of an external electrical plug to be inserted therethrough. The cover assembly further includes at least one platform sub-assembly, wherein each platform sub-assembly rests in the cover behind one pair of the apertures. The platform sub-assembly includes a slider, a platform, and a leaf spring. The slider having a slider aperture rests in the platform and is held in position by the leaf spring that is positioned juxtaposed to the slider for loading the slider into a misaligned position where the slider aperture is misaligned with respect to the aperture in the cover such that an object is blocked from entering into either of the apertures in the cover.

The leaf spring, the platform and the cover confine the slider in the misaligned position when an object probes only one aperture in the cover. This misaligned position is maintained until a pair of prongs are inserted into the pair of apertures, causing the slider to slide into an aligned position wherein the slider aperture aligns with one of the pair of apertures of the cover, thereby enabling a first prong to slip through both the cover aperture and the slider aperture, and a second prong to slip through the other cover aperture and bypassing the slider. In this alignment position, the slider is designed to be just wide enough so that the when the slider aperture aligns with one aperture in the cover, the slider does not cover the other respective aperture. Upon removal of the pair of prongs from the receptacle terminals, the leaf spring urges the slider back into the misaligned position.

Another embodiment of the tamper-resistant electrical receptacle of the present invention includes a base assembly attached to a cover assembly, wherein the apertures in the cover assembly align with the receptacle terminals in the base assembly. The cover assembly includes a cover having at least one pair of apertures for at least one pair of prongs of an external electrical plug to be inserted therethrough. Moreover, the cover includes an upper rib formed on the interior surface of the cover. The cover assembly further includes at least one platform sub-assembly, wherein each platform sub-assembly rests in the cover behind one pair of the apertures. The platform sub-assembly includes a slider, a platform, and a leaf spring. The slider having a slider aperture rests in the platform and is held in position by a leaf spring that is positioned juxtaposed to the slider for loading the slider into a misaligned position where the slider aperture is misaligned with respect to the aperture in the cover such that an object is blocked from entrance into either of the pair of apertures in the cover.

The platform includes a lower rib formed on its interior surface. When an object is inserted into only one first aperture of the cover, the upper rib formed on the interior surface of the cover blocks movement of the slider from transitioning from the misaligned position into an align position wherein the receptacle terminals are left open and accessible. In the alternative when an object is inserted into only one second aperture of the cover, the lower rib formed on the interior surface of the platform blocks movement of the slider from transitioning from the misaligned position into an align position wherein the receptacle terminals are left open and accessible. Thereby the upper rib of the cover and the lower rib of the platform confine the slider to the misaligned position when an object probes only one aperture in the cover. This misaligned position is maintained until the pair of prongs are inserted into the pair of apertures causing the slider to slide into an aligned position where the slider aperture aligns with one of the pair of apertures in the cover enabling a first prong to slip through both the aperture and the slider aperture, and a second prong to slip through a corresponding one of the pair of apertures bypassing the slider.

In the alignment position, the slider is designed to be just wide enough so that when the slider aperture aligns with one aperture in the cover, the slider does not cover the other aperture. After the pair of prongs are removed from the receptacle terminals, the leaf spring moves the slider back into the misaligned position.

Advantages of this design include but are not limited to, a tamper-resistant electrical receptacle that is permanent in that once the unit is installed it offers protection for the life of the building structure. The tamper-resistant electrical receptacle in accordance with the present invention is reliable since this receptacle is not manually removable. In addition, a user need not be concerned about losing the associated part that makes the electrical receptacle tamper-resistant. Further, a user need to be concerned with breaking the tamper-resistant electrical receptacle because the platform sub-assembly is secured behind the cover of the electrical receptacle. Moreover, the tamper-resistant electrical receptacle provides automatic protection even when a plug is removed because the spring loaded slider retracts back to the closed position for immediate protection.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 8 illustrates an exploded view of the base and cover assembly in accordance with the present invention;

FIG. 9 displays the tamper resistant assembly in accordance with the present invention;

DETAILED DESCRIPTION OF PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
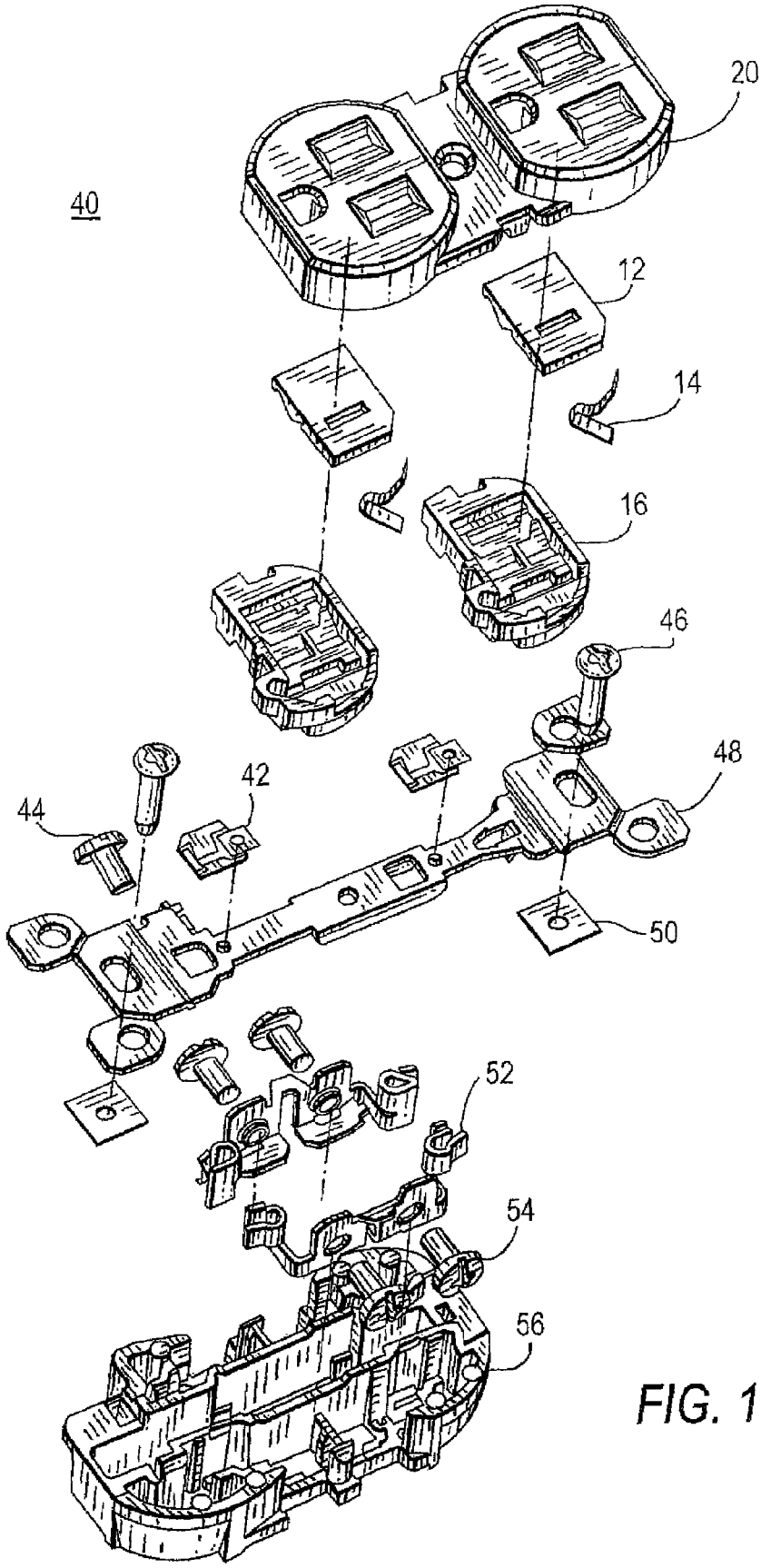
FIG. 1 shows an exploded view of a 15 ampere embodiment of the tamper resistant assembly in accordance with the present invention.

Specifically, a tamper resistant electrical receptacle in accordance with the present invention includes a base assembly that connects to a cover assembly, wherein the cover assembly includes a platform sub-assembly having a platform, a slider, and a leaf spring. The slider positioned is placed in a first position to block entry into the cover assembly when an object is inserted into only one cover aperture which is the typical scenario for children probing electrical receptacles. When, however, a pair of prongs are inserted into the electrical receptacle, the slider shifts out of the way into a second position that enables the pair of prongs to engage receptacle terminals located in the base assembly. Thereby, this electrical receptacle effectively prevents electric shock FIGS. 1-14*b* illustrate a first embodiment of the tamper resistant receptacle 40 in accordance with the present invention. Specifically, FIG. 1 shows an exploded view of the tamper resistant electrical receptacle 40 in accordance with the present invention. The receptacle 40, as shown in FIG. 1, is a duplex three-prong electrical receptacle for handling 15 amp current applications. However, it should be understood that the receptacle can be a two or three-prong electrical receptacle or a receptacle other than that of a duplex receptacle.

As shown in FIG. 1, cover 20 sits on top of a pair of platform sub-assemblies including platform 16, leaf spring 14 and slider 12. Mounting screws 46 mount strap 48 onto the base 56 using retaining washers 50. Ground contacts 42 connect onto strap 48. Finally, contacts 52 connect to the base 56 using terminal screws 54 to form the receptacle terminals in base 56.

Figure 2:
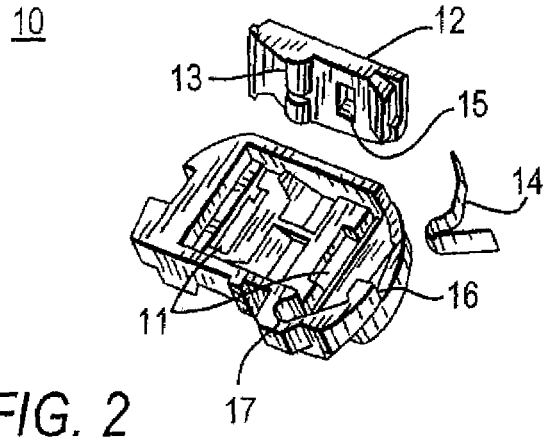
FIG. 2 illustrates an exploded view of a 15 ampere embodiment of the platform sub-assembly in accordance with the present invention.
Figure 14A:
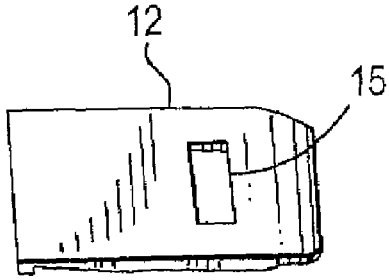
FIGS. 14*a* and 14*b* illustrate the front and back side of the slider in accordance with one embodiment of the present invention.
Figure 14B:
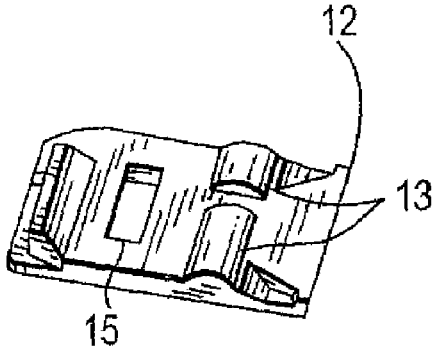

Specifically, referring to FIG. 2, an exploded view of the platform sub-assembly includes a slider 12, a leaf spring 14, and a platform 16. Slider 12 includes at least one rib 13. It is noted that rib 13 may be one or more projections as shown in FIGS. 2 and 14*b*. A slider aperture 15 is included in slider 12 to enable one prong to be inserted through to make contact with the receptacle terminals in the base of the tamper resistant receptacle 40. The cover 20 may include at least one pair of apertures. As such, slider aperture 15 must align with at least one of the apertures from an aperture pair of cover 20 to enable a prong to pass through the slider aperture 15 to a receptacle terminal which shall be explained in further detail.

Figure 3:
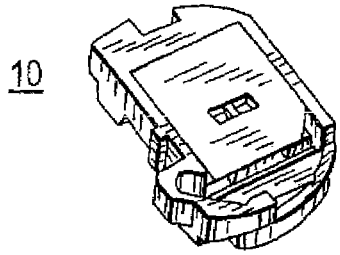
FIGS. 3, 7*a*, and 7*b* display the platform sub-assembly completely assembled in accordance with the present invention.
Figure 5A:
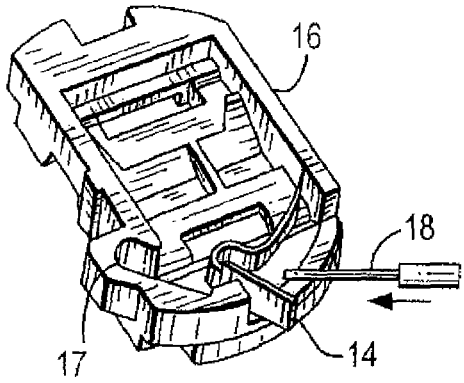
FIGS. 5*a* and 5*b* display two views of the leaf spring placement by a suitable tool into the platform in accordance with the present invention.
Figure 5B:
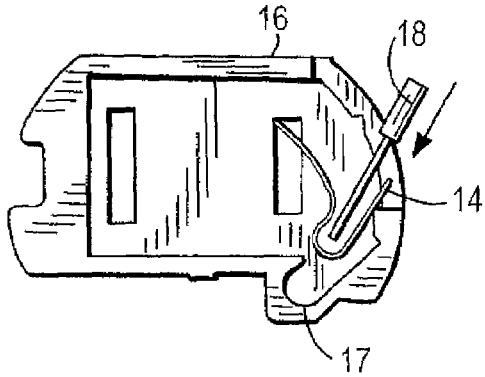
Figure 6A:
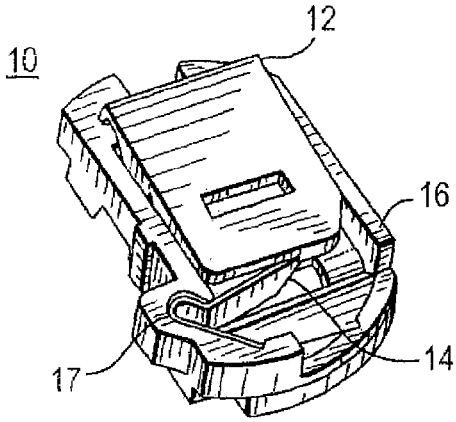
FIGS. 6*a* and 6*b* illustrate the placement of the slider into the platform, next to the leaf spring.
Figure 6B:
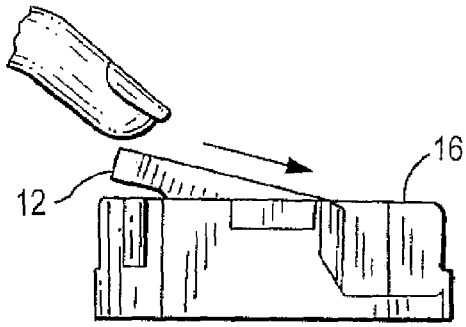
Figure 7A:
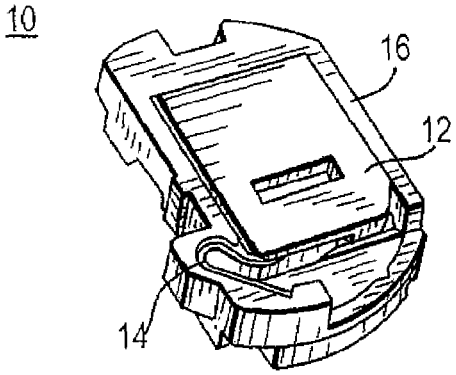
Figure 7B:
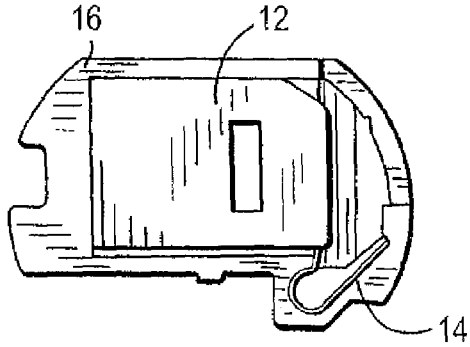

Leaf spring 14 is mounted in pocket 17 of platform 16 as is shown in the series of FIGS. 5*a*, 5*b*, 6*a*, 6*b*, 7*a*, and 7*b*. Accordingly, pocket 17 is configured to allow leaf spring 14 to rest in platform 16 and to hold slider 12 in place in a first position wherein the slider aperture 15 is misaligned with either aperture 11 of the platform 16. Specifically, leaf spring 14 is driven into pocket 17 using an appropriate tool 18 as shown in FIG. 5*a*. FIG. 5*b* displays the top view of the insertion of the leaf spring 14 into the platform using the tool 18. It should be noted that leaf spring 14 can be manually or mechanically placed into the platform sub-assembly. Likewise slider 12 is inserted either manually or mechanically as is shown in FIGS. 6*a* and 6*b*. FIGS. 3, 7*a*, and 7*b* show the completed platform sub-assembly from differing views, including isometric and top views.

Figure 4:
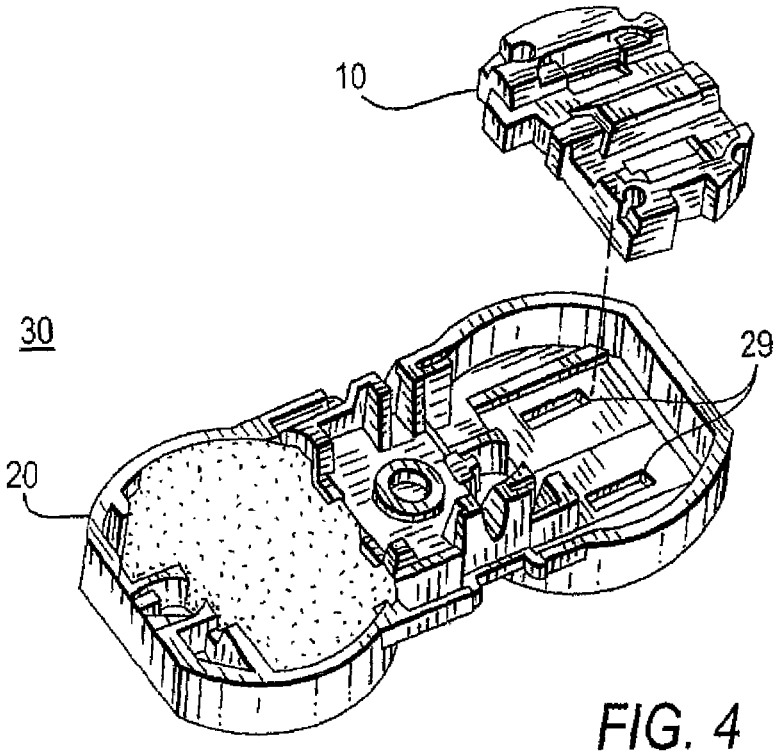
FIG. 4 shows the cover assembly in accordance with the present invention.

Referring to FIG. 4, the fully assembled cover assembly 30 includes at least one platform assembly 10 seated in the cover 20 behind the pair of apertures 29. In one embodiment the cover 20 and the platform sub-assembly 10 are held together by interference fit.

FIG. 8 displays cover assembly 30 aligned with the base assembly 36 to be combined to make tamper-resistant receptacle 40 shown in FIG. 9. Base assembly 36 includes all elements associated with a known electrical receptacle (i.e. strap, contacts, etc). The fully assembled tamper resistant receptacle 40 in accordance with the present invention is shown in FIG. 9. As shown, the outside of the 15 A, (125V) version of the tamper resistant receptacle in accordance with the present invention looks the same as an existing Leviton receptacle with the exception of the tamper-proof prong apertures. Accordingly, receptacle 40 offers the same features relative to the mounting strap.

The receptacle 40, shown in FIG. 10, is shown as a duplex three-prong electrical receptacle for handling 15 amp current applications. However, it should be understood that the receptacle can be a single two or three-prong electrical receptacle or a receptacle having capabilities greater than that of a duplex receptacle. In addition, the receptacle can have ground fault circuit interrupter (GFCI) capabilities. Moreover, the receptacle can be selected to handle other current capacities such as 20 amp, 30 amp, and 50 amp and other capacities.

Figure 12:
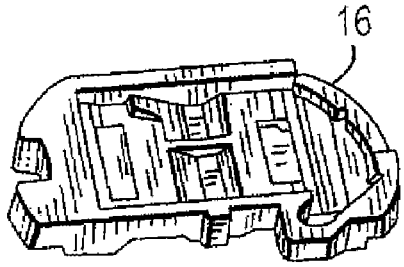
FIG. 12 displays the platform in accordance with one embodiment of the present invention.
Figure 13:
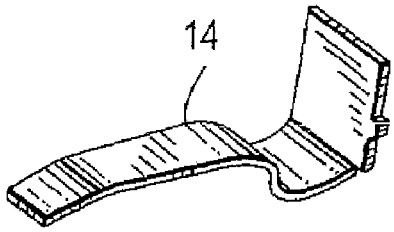
FIG. 13 shows the leaf spring in accordance with one embodiment of the present invention.

For another perspective, FIG. 12 provides a top view of platform 16. Furthermore, FIG. 13 provides a more detailed view of leaf spring 14. Moreover, FIGS. 14*a* and 14*b* displays front and back views of slider 12 for a more direct view of the ribs 13 formed on the back side of slider 12.

Figure 10A:
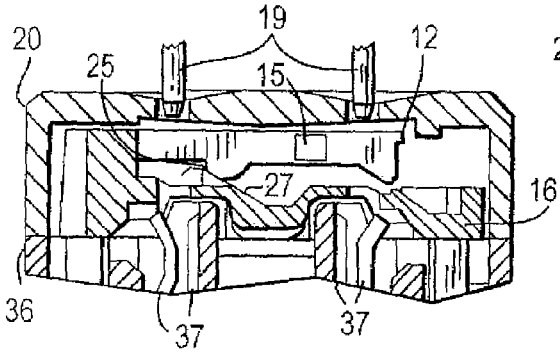
FIGS. 10*a* and 10*b* show the tamper resistant assembly when a pair of prongs from an electrical appliance are inserted into the pair of apertures in the cover at two respective depths.
Figure 10B:
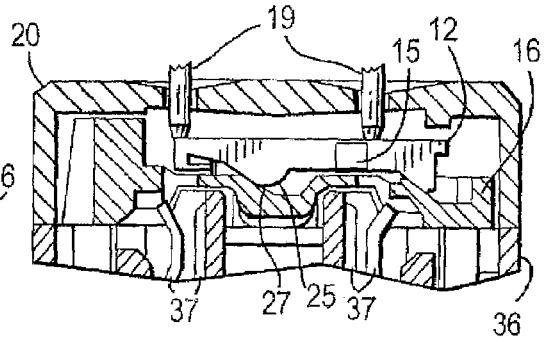

FIGS. 10*a* and 10*b*, illustrate what happens when an electrical plug having a pair of prongs is inserted in the apertures of the cover 20. As shown in FIG. 10*a*, just prior to having a pair of prongs inserted through the apertures in cover 20, the slider 12 blocks direct entry into the receptacle terminals formed by contacts 37. This first position for slider 12 is referred to as a misaligned position. As prongs 19 are inserted further, projection 25 of slider 12 slides into a second position down the slope 27 such that slider aperture 15 comes into alignment with one of the prongs 19. FIG. 10*b* illustrates the slider in an intermediary position, mid-way between the first position and the second position. This second position is referred to as an alignment position. As shown in FIG. 10*b*, projection 25 slides down slope 27 which brings slider aperture 15 closer in alignment with one of prongs 19. Once the slider 12 transitions completely to the second position, slider 12 aligns with the cover apertures, 39 and 41, to allow a first prong of prongs 19 to bypass on side of slider 12 and a second prong of prongs 19 to pass through slider aperture 15. As such, the width of the slider 12 is designed such that the other prong gains clearance straight through to the receptacle terminal when slider aperture 15 aligns with the aperture in cover 20. Thus, for this particular embodiment, the width between the slider aperture 15 and far end of the slider 12 should substantially equal the width that exists between the apertures in the cover 20. The first and second prongs 19 engage with receptacle terminals 37 to complete electrical contact with 40 once slider 12 has transitioned completely to the second position.

As shown in FIG. 6*a*, leaf spring 14 rests in pocket 17 juxtaposed to slider 12 in the first position. When the slider 12 transitions to the second position, the slider moves toward the pocket 17 and the leaf spring 14. As a result, the leaf spring 14 is compressed to the edge of the platform 16. Leaf spring 14 is designed to retract to its original position after being compressed similar to a conventional spring. Thus, when the prongs 19 are withdrawn, the leaf spring 14 springs slider 12 back to the first position.

Figure 11A:
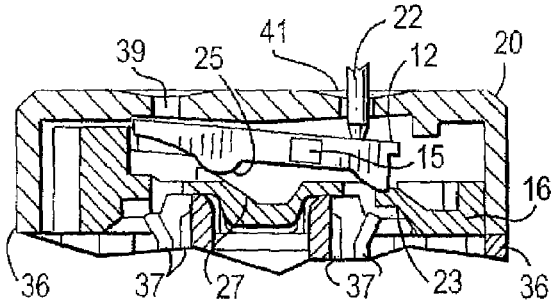
FIGS. 11*a* and 11*b* displays the tamper resistant assembly when a single object is used to probe apertures, 39 and 41, in the cover, respectively.
Figure 11B:
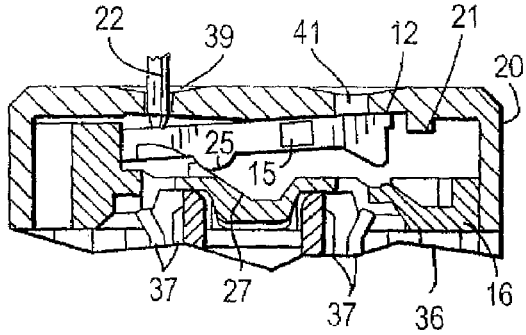

FIGS. 11*a* and 11*b*, display what happens when a simple straight insertion is attempted only through either the cover aperture, 41 or 39, respectively. In this case, when an object is inserted into either aperture 39 or 41, slider 12 remains confined in the misaligned position or the first position. Specifically, FIG. 11*a* illustrates an object 22 being inserted in the aperture 41 of cover 20. As object 22 pushes slider 12 down towards the platform 16, the lower rib or projection 23 restricts the movement of the slider 12, such that slider 12 just tilts as oppose moving into the second position. Thereby, object 22 is prohibited from making contact with contacts 37 which form each receptacle terminal. In the alternative, FIG. 11*b* displays an object 22 inserted in the aperture 39 of cover 20. As shown, slider 12 is pushed downward towards platform 16 and is restricted from further movement down the slope 27 due to projection 21 formed in the cover 20. Similarly, as a result, slider 12 is disabled from transitioning to the second position. Thus, object 22 which probes the electrical receptacle 40 unsuccessfully makes contact with the accessible power of contacts 37 which form the receptacle terminal.

It should be noted that while most tamper resistant receptacles require a sloped surface to be engaged by the plug prong in order to obtain a lateral move, this mechanism incorporates a flat surface (i.e. the top surface of slider 12) instead for the prongs to push on in combination with a sloped surface in the interior surface of the platform 16 that causes the slider to move sideways as it is being pushed by prongs 19.

Figure 15:
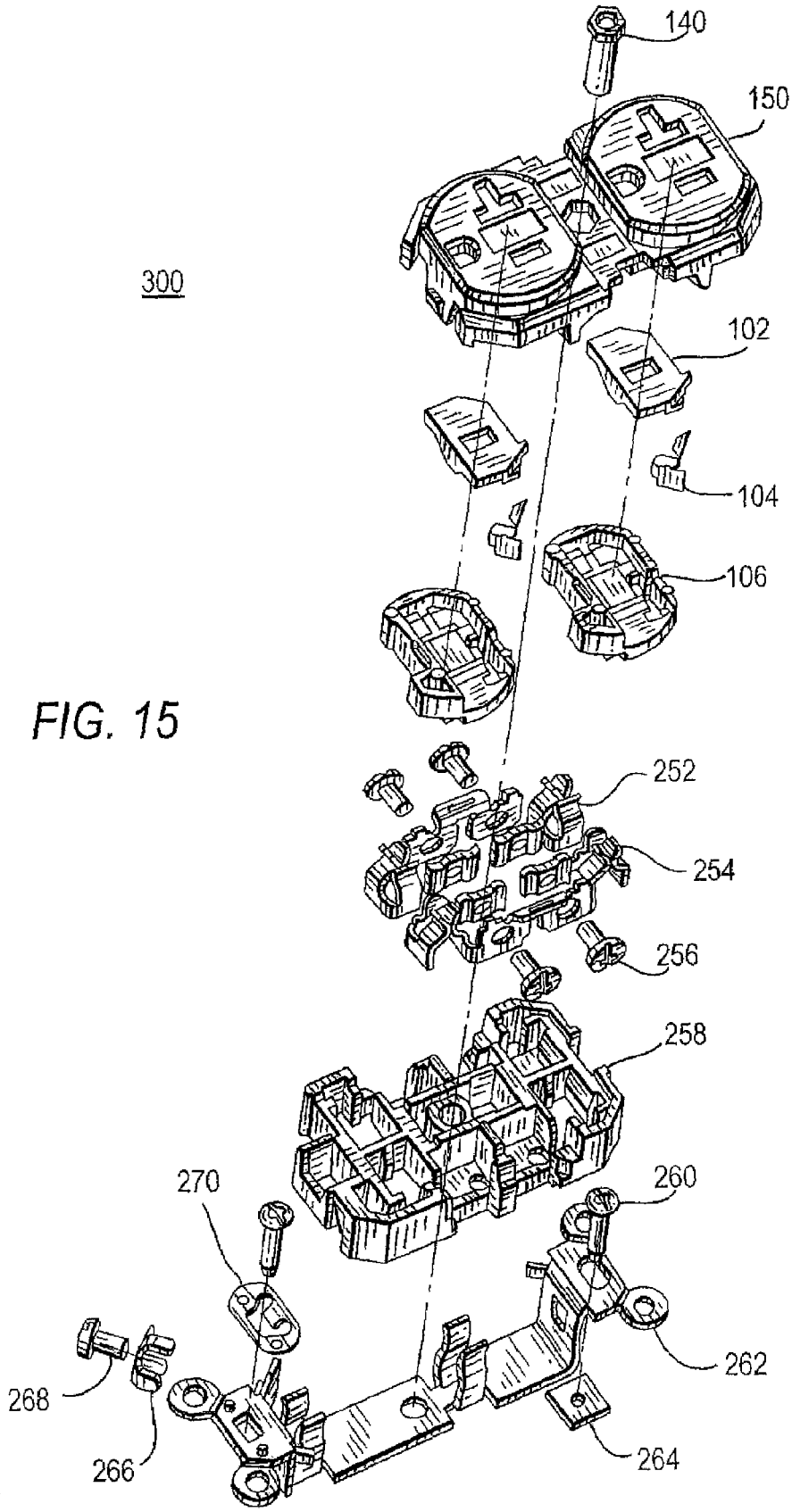
FIG. 15 shows an exploded view of the 20 ampere embodiment of the tamper resistant assembly in accordance with the present invention.

FIGS. 15-27 depict the component assemblies for a second embodiment of the tamper-resistant receptacle 300 in accordance with the present invention. The receptacle 300, as shown in FIG. 15, is a duplex three-prong electrical receptacle for handling 20 amp current applications. However, it should be understood that the receptacle can be a single two or three-prong electrical receptacle or a receptacle other than that of a duplex receptacle. In addition, the receptacle can have ground fault circuit interrupter (GFCI) capabilities. The receptacle also can be selected to handle other current capacities such as 30 amp, 50 amp, and other capacities.

FIG. 15 shows an exploded view of the 20 ampere embodiment of the tamper resistant electrical receptacle in accordance with the present invention. From the top of FIG. 15, cover 150 sits on top of platform sub-assembly 100 including platform 106, leaf spring 104 and slider 102. Terminal screws 256 connect the contacts 254 and nut 252 together within base 258. Screws 260 mounts strap 262 onto the base 258 using washers 264. Ground screw 268 secures ground clamp 266 and ground clip 270 to strap 262.

Figure 16A:
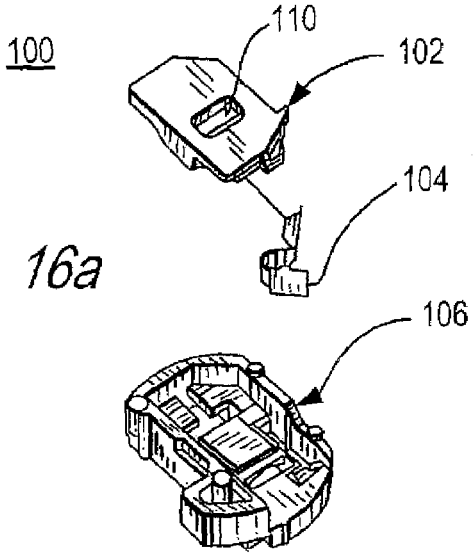
FIG. 16*a* illustrates an exploded view of a 20 ampere embodiment of the platform sub-assembly in accordance with the present invention.

In particular, and focusing upon the platform sub-assembly 100, FIG. 16*a* illustrates an exploded view of the platform sub-assembly 100 which includes a slider 102, a leaf spring 104, and a platform 106. Slider 102 includes at least one rib 120 displayed in FIGS. 22*a*, 22*b*, 24*a* and 24*b*. Similar to the previously described embodiment 40, it is noted that rib 120 may be one or more than one projections (not shown). Slider 102 includes a slider aperture 110 for alignment with the aperture of cover 150 which is explained in detail hereinafter. Leaf spring 104 is mounted in the pocket 107 of platform 106 as is shown in the series of FIGS. 18*a*, 18*b*, 19*a*, 19*b*, 20*a*, and 20*b*. FIGS. 23*a* and 23*b*, front and back views of leaf spring 104.

Figure 16B:
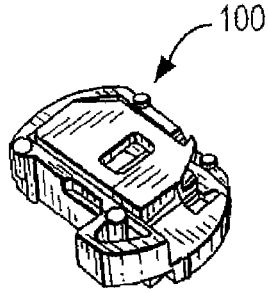
FIGS. 16*b*, 20*a* and 20*b* display the platform sub-assembly completely assembled in accordance with the present invention.
Figure 18A:
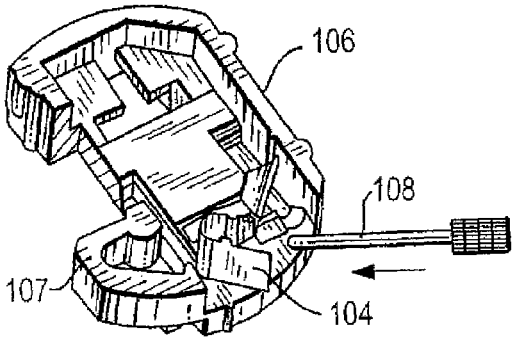
FIGS. 18*a* and 18*b* display two views of the leaf spring placement by a suitable tool into the platform in accordance with the present invention.
Figure 18B:
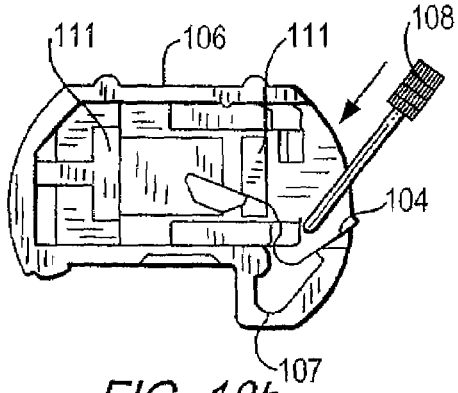
Figure 19A:
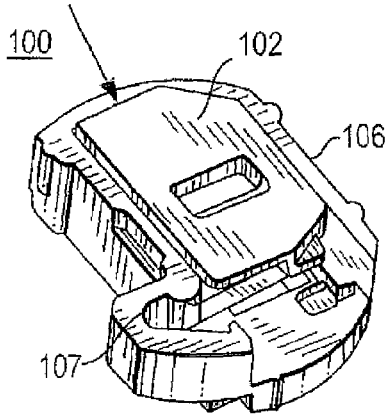
FIGS. 19*a* and 19*b* illustrate the placement of the slider into the platform, next to the leaf spring.
Figure 19B:
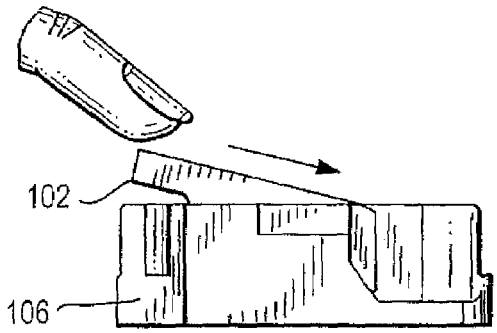
Figure 20A:
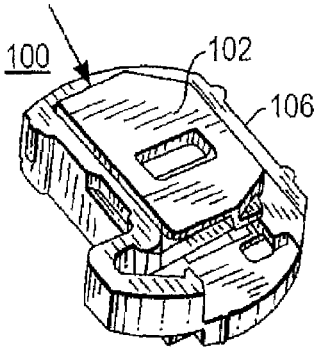
Figure 20B:
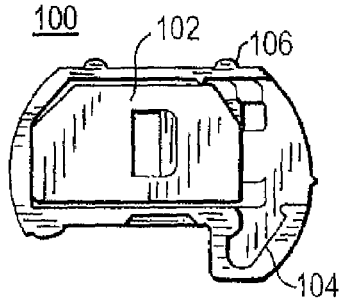

Accordingly, leaf spring 104 rests in the pocket 107 of platform 106 to bias slider 102 in place in a first position where the slider aperture 110 is misaligned with either aperture 111 of the platform 106. Specifically, leaf spring 104 is driven into pocket 107 using an appropriate tool 108 as shown in FIG. 18*a*. FIG. 18*b* displays the top view of the insertion of the leaf spring 104 into the platform using the tool 108. Although FIG. 18*a* refers to the platform assembly being manually assembled, it should be recognized by those skilled in the art that leaf spring 104 may be manually or mechanically inserted. FIGS. 19*a* and 19*b* show the platform sub-assembly being assembled by hand, wherein the slider is pushed into the slot within the platform juxtaposed to the leaf spring which holds the slider in place. The fully assembled sub-assembly 100 is shown in FIGS. 16*b*, 20*a*, and 20*b* includes the platform 106, leaf spring 104, and slider 102. These are placed in the cover assembly 200 as shown in FIG. 17.

Figure 17:
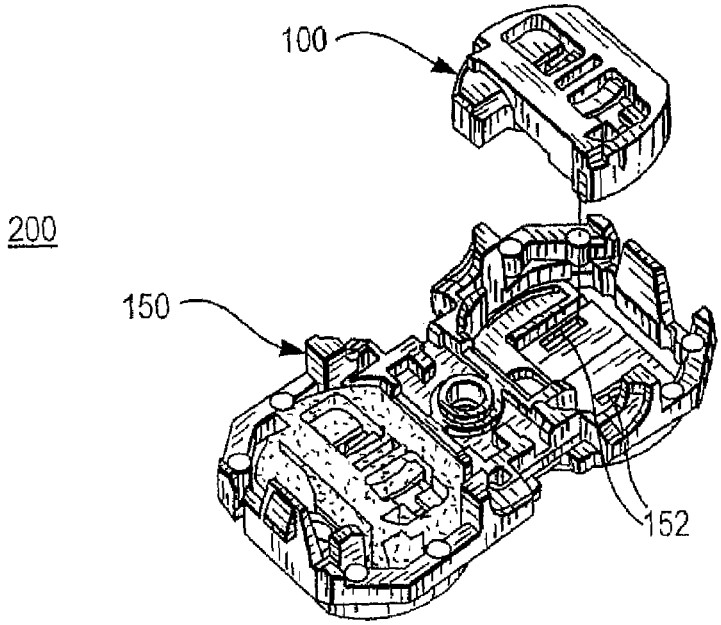
FIG. 17 shows the cover assembly in accordance with the present invention.
Figure 26:
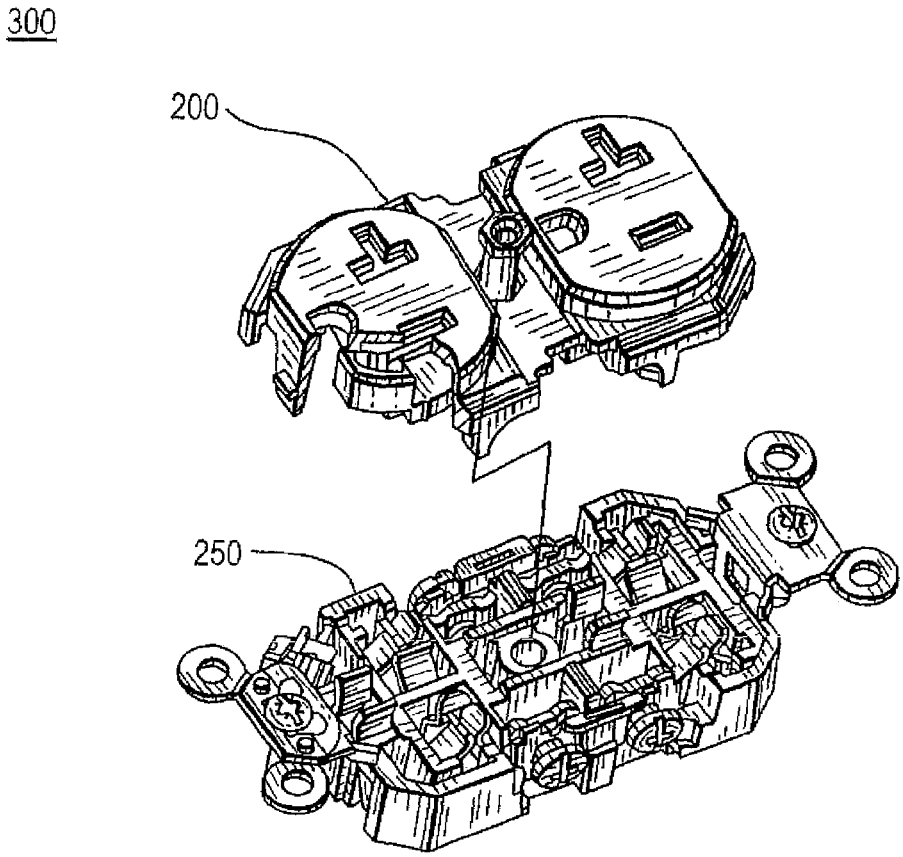
FIG. 26 illustrates an exploded view of the base and cover assembly in accordance with the present invention.
Figure 27:
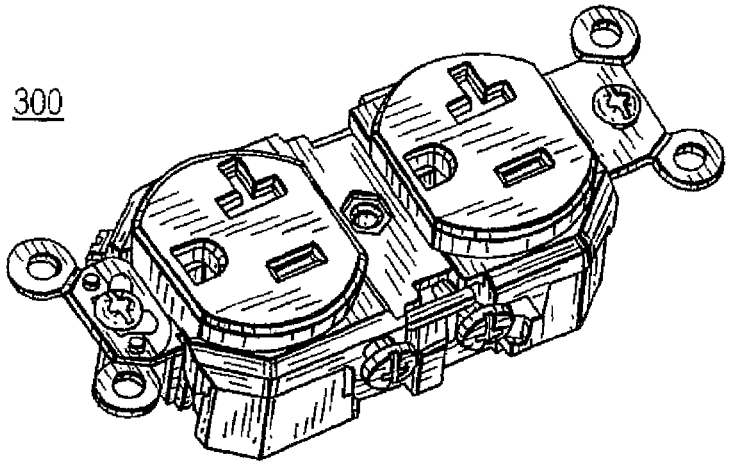
FIG. 27 displays the tamper resistant assembly in accordance with the present invention.

Referring to FIG. 17, the fully assembled cover assembly 200 includes at least one platform assembly 100 seated in the cover 150 behind the pair of apertures 152. In one embodiment the cover 150 and the platform sub-assembly 100 are held together by interference fit. The resulting cover assembly 200 is attached to the base assembly 250 as shown in FIGS. 26 and 27 to form the tamper resistant electrical receptacle 300. Specifically, FIG. 26 displays cover assembly 200 aligned with the base assembly 250 to be combined to make tamper-resistant receptacle 300. Base assembly 250 includes all elements associated with a known electrical receptacle (i.e. strap, contacts, etc). The fully assembled tamper resistant receptacle 300 in accordance with the present invention is shown in FIG. 27. The outside of the 20 A, (125V) version of the tamper resistant receptacle in accordance with the present invention looks the same as an existing Leviton receptacle with the exception of the tapered blade slots. The tamper-resistant receptacle offers the same features of the known receptacle including but not limited to those associated with the wrap around mounting strap. The marking on the face of the tamper-resistant receptacle helps to identify and distinguish it from the known electrical receptacle.

Figure 21A:
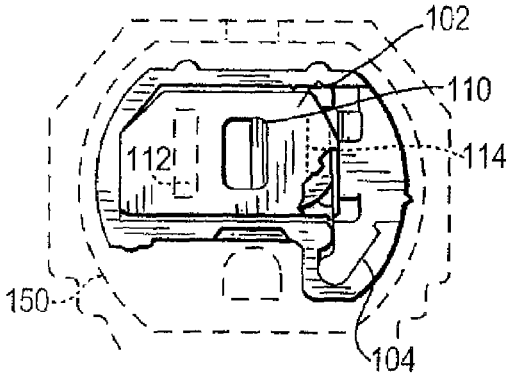
FIGS. 21*a* and 21*b* show the tamper resistant assembly prior to and after the insertion of a pair of prongs from an electrical appliance into the pair of apertures in the cover.
Figure 22A:
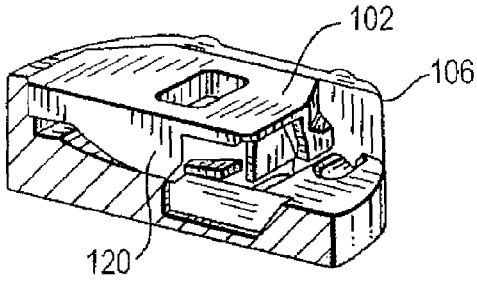
FIGS. 22*a* and 22*b* display another view of the tamper resistant assembly prior to and after the insertion of a pair of prongs from an electrical appliance into the pair of apertures in the cover.
Figure 23A:
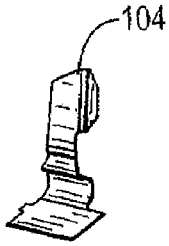
FIGS. 23*a* and 23*b* illustrate the front and back side of the leaf spring in accordance with one embodiment of the present invention.
Figure 23B:
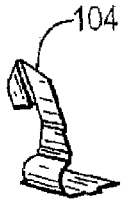
Figure 24A:
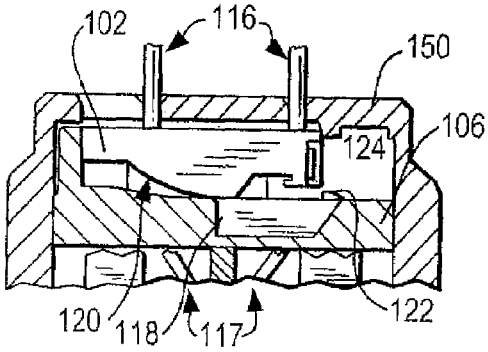
FIGS. 24*a* and 24*b* show the tamper resistant assembly when a pair of prongs from an electrical appliance are inserted into the pair of apertures in the cover at two respective depths.

In operation, slider 102 is initially in a first position where the slider blocks each aperture, 112 and 114, in the cover 150 as shown in FIGS. 21*a* and 22*a*. As shown, leaf spring 104 engages the slider 102 in the first position wherein the slider aperture 110 is misaligned with the aperture, 112 or 114, in the cover 150. As shown in FIG. 24*a*, rib 120 of slider 102 comes in contact with the cavity 118 of platform 106 allowing the slider 102 to move laterally. Leaf spring 104 biases slider 102 and retains the slider 102 to one side in a position where the slider aperture 110 is misaligned with either aperture, 112 or 114, in the cover 150. Similar to the previous embodiment as shown in FIG. 14*b*, it is noted that rib 120 may be more than one rib on the bottom slider 102.

Figure 21B:
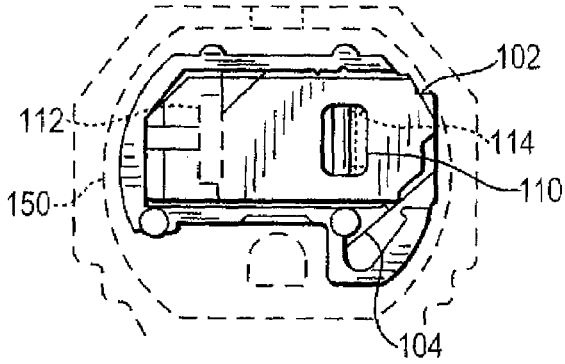
Figure 22B:
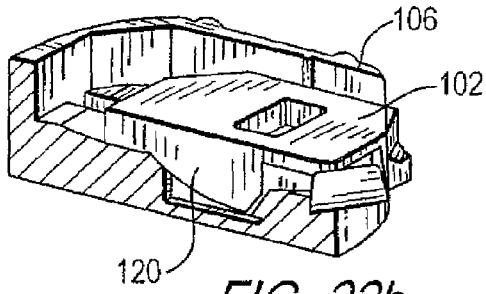
Figure 24B:
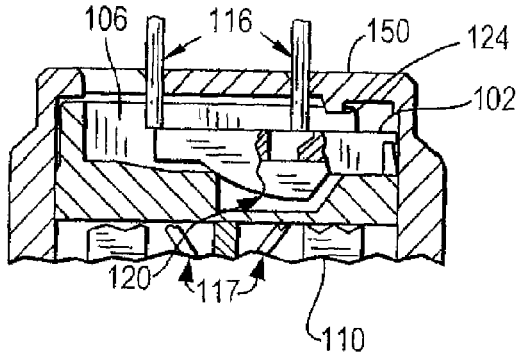

Further, as shown in FIG. 24*a* when a conventional electrical plug having a pair of prongs are inserted into the cover 150 of receptacle 300 through the apertures in cover 150, the slider blocks entry into the receptacle terminals formed by contacts 117. As the prongs 116 are inserted further, the projection 120 of slider 102 slides into a second position down into cavity 118 such that slider aperture 110 comes into alignment with one of the prongs 116. FIG. 24*b* illustrates the slider 102 in an intermediary position, midway between the first position and the second position. As shown in FIG. 24*b*, projection 120 slides down into chamber 118 which brings slider aperture 110 closer in alignment with one prong 116. Once the slider 102 transitions completely to the second position, slider 102 aligns with the cover apertures, 112 and 114, to allow a first prong of prongs 116 to bypass on side of slider 102 and a second prong of prongs 116 to pass through slider aperture 110. As such, the width of the slider 102 is designed such that the other prong gains clearance straight through to the receptacle terminal when slider aperture 110 aligns with the aperture in cover 150. When the slider 102 is in the alignment position, the prongs are allowed to enter through cover assembly 200 so as to engage the contacts 117 that form the receptacle terminals for the receptacle 300. FIGS. 21*b* and 22*b*, illustrate the alignment position wherein the slider 102 has shifted into the second position providing clearance for both apertures, 112 and 114, in cover 150. In this position, slider 102 presses against the leaf spring 104 and is held in the alignment position by the prongs 116 which are inserted therein. When the prongs 116 are removed, the biasing force of the leaf spring 104 urges slider 102 back into the misaligned position as shown in FIGS. 21*a* and 22*a*. FIGS. 22*a* and 22*b*, depict the slider 102 in the first and second positions similar to FIGS. 21*a* and 21*b*, but from a different angle.

Figure 25A:
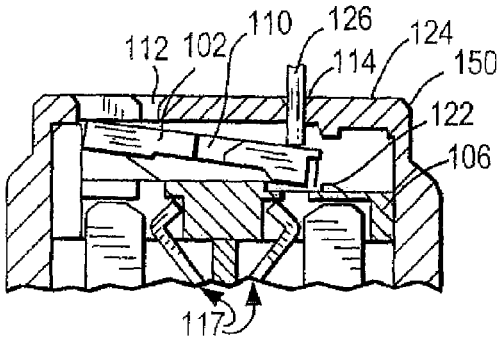
FIGS. 25*a* and 25*b* display the tamper resistant assembly when a single object is used to probe the apertures; 112 and 114: in the cover, respectively.
Figure 25B:
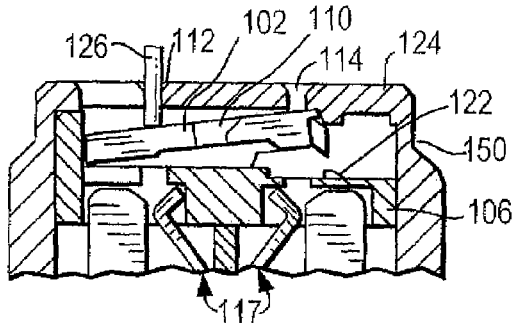

Specifically, FIGS. 24*a* and 24*b*, differ from FIGS. 25*a* and 25*b*, in that the viewing prospective of the diagram for FIGS. 24*a* and 24*b*, shows a cross-section view of FIG. 27 taken along Section line A-A where the cut extends through receptacle 300 at the point through either rib 120. FIGS. 25*a* and 25*b*, show a cross-section view of FIG. 27 taken along Section line B-B which represents a cut through the space that lies between ribs 120. Thus, rib 120 is not shown in FIGS. 25*a* and 25*b* since the cut is in the section between the two part rib 120 (reference FIG. 14*b*).

In the case where an object is inserted into either aperture, the slider 102 remains confined in the misaligned position or the first position. FIGS. 25*a* and 25*b*, display what happens when an insertion is attempted in either aperture 112 and 114, respectively. As depicted in FIG. 25*a* when an object 126 is inserted in the aperture 114 of cover 150, slider 102 is pushed down towards the platform and is confined by a lower rib or projection 122. Thus, even if a determined attempt is made to force slider 102 in the aperture 114 of the cover 150, projection 122 blocks the slider 102 from movement out of the first position where the slider aperture 110 is misaligned with the aperture in the cover 150. Object 126 is thereby prohibited from making contact with the contacts 117 that form the receptacle terminal.

FIG. 25*b* depicts an object 126 being inserted in aperture 112 of cover 150. As depicted therein, slider 102 pushes downward towards the platform 106 and only limited movement is permitted before the right edge (as shown) of slider 102 is blocked from further movement by projection or rib 124. Thus, projection 124 blocks slider 102 from movement out of the first position, wherein slider aperture 110 is misaligned with the aperture in the cover 150.

Note that while most tamper resistant concepts require a sloped surface to be engaged by the plug blade in order to obtain a lateral move, the tamper resistant electrical receptacle 100 in accordance with the present invention includes a flat surfaced slider 102 for the blades to push on. A sloped surface 120 in the interior surface of the slider 102 causes the slider 102 to move laterally into cavity 118 defined by platform 106.

Figure 28A:
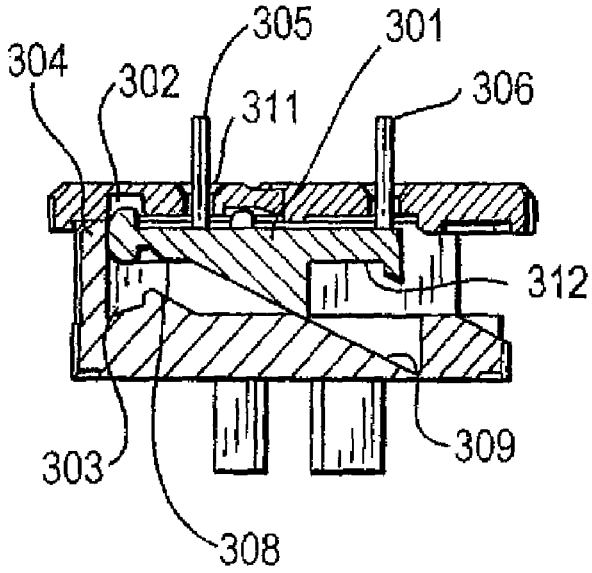
FIGS. 28*a* and 28*b* depict a tamper resistant assembly in accordance with the present invention prior to and after insertion of a pair of prongs from an electrical appliance.
Figure 28B:
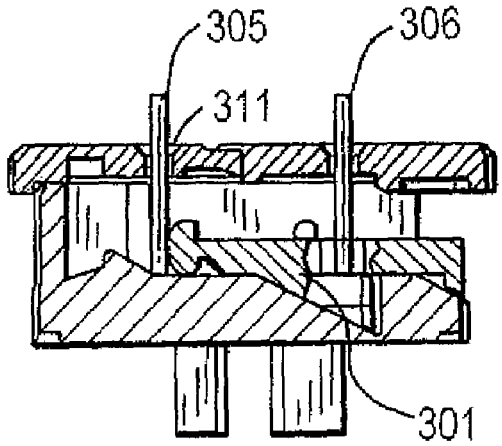

FIGS. 28 and 29 discloses another embodiment of the present invention comprising a shutter having a different geometry than those of the embodiments previously described herein. As is depicted in FIG. 28*a*, a receptacle 300 in accordance with this embodiment comprises a shutter 301 shaped such that a locking end 304 is adapted to nestle in pocket 302, engage tab 308 or slide down ramp 309 depending on the type of force applied to the shutter. As shown in FIG. 28*a*, when prongs 305 and 306 are inserted into apertures 310 and 311 respectively an evenly distributed force is placed on shutter 301 thereby causing shutter 301 move from a first position as shown in FIG. 28A, to a second position as shown in FIG. 28*b*.

Figure 29A:
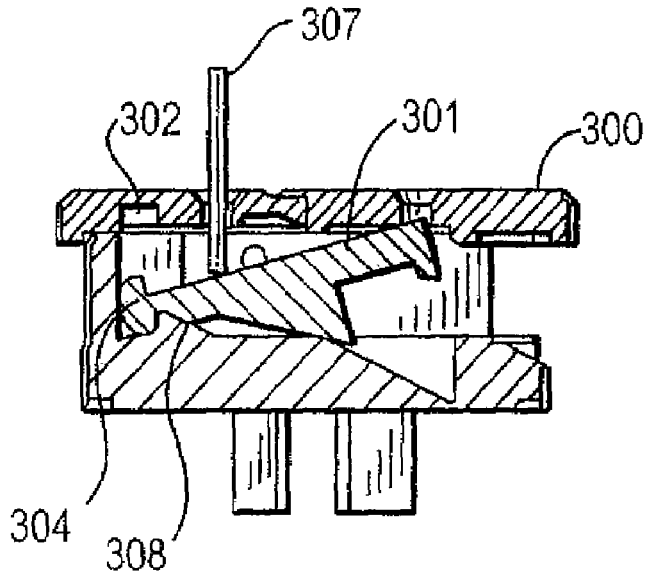
FIGS. 29*a* and 29*b* depict a tamper resistant assembly in accordance with the present invention when a single object is used to probe apertures in the assembly.
Figure 29B:
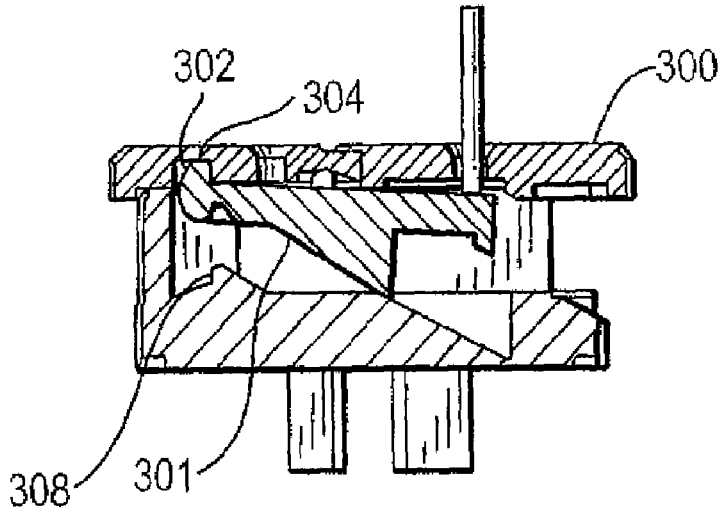

With a balanced force applied to the shutter 301, the shutter 301 slides down ramp 309 thereby permitting prong 305 to slide past locking end 304 and allowing prong 306 to penetrate shutter aperture 312. This condition is depicted in FIG. 28*b*. In the instance where a projection is placed in only one of the apertures of the receptacle 300, the shutter 301 is thereby subjected to an unbalanced force and prevented from translating along ramp 309 by locking end 304. This condition is depicted in FIGS. 29*a* and 29*b*. FIG. 29*a* depicts the resulting condition when a projections placed in the left aperture of receptacle 300. When this occurs, shutter 301 is caused to pivot such that locking end 304 engages tab 308, thereby preventing any translation of shutter 301 from its initial position. FIG. 29*b* depicts the case where a single projection is placed in the right aperture of receptacle 300. When this occurs, shutter 301 is again caused to pivot. However in this instance locking end 304 is made to fully nestle in pocket 302, thereby causing locking end 304 to engage the body of the receptacle 300 and preventing translation of shutter 301. This embodiment permits the shutter 301 to translate a distance greater than that afforded by the other embodiments of the invention. In this embodiment the preferred distance is 0.375" whereas in the prior embodiments the preferred distance is 0.125"

Those of skill in the art will recognize that the physical location of the elements illustrated in FIGS. 1 and 15 can be moved or relocated while retaining the function described above. For example, the location and shape of the leaf spring may be adjusted or reversed and the function of the tamper resistant assembly in accordance with the present invention will remain.

Advantages of this design include but are not limited to a tamper-resistant electrical wiring device system having a high performance, simple, and cost effective design.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

We claim:

1. An electrical receptacle comprising:

a cover having an interior surface, an exterior surface, and at least one pair of cover apertures;

a retractable slider, having a slider aperture, seated in the interior surface of the cover in a first position blocking the pair of cover apertures, wherein when an object is inserted into only one of the pair of cover apertures, the retractable slider is constrained in the first position; and a base assembly, having at least one pair of receptacle terminals, the base assembly coupled to the cover;

wherein when a pair of prongs are inserted though the pair of cover apertures, the retractable slider moves from the first position to a second position, wherein in the second position the slider aperture aligns with at least one of the pair of cover apertures to enable the prongs to make contact with the receptacle terminals, whereby the retractable slider retracts back to the first position when the prongs are removed.

2. An electrical receptacle as recited in claim 1, wherein the interior surface of the cover includes a projection that blocks the retractable slider from moving into the second position when the object is inserted into only one of the pair of cover apertures.

3. An electrical receptacle as recited in claim 1, wherein the retractable slider comprises:

a platform having a recess, the slider seated in the recess of the platform; and a leaf spring seated in the recess juxtaposed to the slider, wherein the leaf spring holds the slider in the first position.

4. An electrical receptacle as recited in claim 1, wherein the base assembly comprises:

a base, having at least one contact; and a strap coupled to the base to secure the base assembly for mounting.

5. An electrical receptacle as recited in claim 4, wherein the base assembly further comprises:

a ground clamp;

a ground clip;

a ground screw coupled to the ground clamp and the ground clip to secure the ground clamp and the ground clip to the strap.

6. A tamper-resistant electrical outlet for electrical connection between an appliance having a pair of prongs and a power distribution system, the tamper-resistant electrical outlet comprising:

a base assembly having a pair of receptacle terminals; and a cover assembly coupled to the base assembly in alignment with the pair of receptacle terminals, wherein the cover assembly comprises, a cover having at least one pair of apertures to permit at least one pair of prongs of an external electrical plug to be inserted therethrough and into the pair of receptacle terminals, and at least one slider, wherein said at least one slider rests in the cover behind one pair of the apertures, wherein said at least one slider is confined in a first position such that said at least one slider blocks the entrance through the pair of apertures to the receptacle terminals, wherein said at least one slider is confined in the first position until the pair of prongs are substantially inserted simultaneously into the pair of apertures causing the slider to move into a second position where the pair of prongs are enabled to pass though the pair of apertures in the cover to engage the receptacle terminals, wherein the slider moves back into the first position after the pair of prongs are removed from the pair of apertures, wherein when an object is inserted into only one of the apertures, said at least one slider tilts and is constrained from moving into the second position such that the object is blocked from engagement with the receptacle terminal.

7. A tamper-resistant electrical outlet for electrical connection between an appliance having a pair of prongs and a power distribution system, the tamper-resistant electrical outlet comprising:

a base assembly having a pair of receptacle terminals; and a cover assembly coupled to the base assembly in alignment with the pair of receptacle terminals, wherein the cover assembly comprises, a cover having at least one pair of apertures for at least one pair of prongs of an external electrical plug to be inserted therethrough and into the pair of receptacle terminals, and at least one platform sub-assembly, wherein said at least one platform sub-assembly rests in the cover behind one pair of the apertures, the platform sub-assembly having a slider having a slider aperture, a platform for holding the slider wherein the slider rests in the platform and a leaf spring juxtaposed to the slider for loading the slider in the platform into a misaligned position where the slider aperture is misaligned with respect to one aperture of the pair of apertures in the cover such that an object is blocked from entrance through the pair of apertures to the receptacle terminals, wherein the leaf spring, the platform and the cover confine the slider in the misaligned position until the pair of prongs are substantially simultaneously inserted into the pair of apertures causing the slider to slide into an aligned position where the slider aperture aligns with one of the pair of apertures in the cover enabling a first prong to slip through both the aperture and the slider aperture, and a second prong to slip through a corresponding one of the pair of apertures bypassing the slider, wherein when an object is inserted into only one of the apertures, the slider tilts and is prohibited from moving into the alignment position such that the object is prohibited from engagement with the receptacle terminal, and wherein the leaf spring biases the slider back into the misaligned position after the first and second prongs are removed from the pair of apertures.

8. A tamper-resistant electrical outlet, comprising:

a base assembly having a pair of receptacle terminals; and a cover assembly coupled to the base assembly in alignment with the pair of receptacle terminals, wherein the cover assembly comprises, a cover having an interior surface, an exterior surface, an upper rib formed on the interior surface, and at least one pair of apertures for prongs of an external electrical plug to be inserted therethrough and into the pair of receptacle terminals, and at least one platform sub-assembly, wherein the platform sub-assembly rests in the cover behind said at least one pair of apertures, the platform sub-assembly having a slider having a slider aperture, a platform, having a top surface and a bottom surface, the top surface for holding the slider wherein the slider rests in the platform, the top surface having a lower rib formed thereon, and a leaf spring placed in juxtaposition with the slider for loading the slider in the platform and confining the slider to a predetermined position wherein when a first and second prong of an electrical plug are inserted though the apertures in the cover assembly simultaneously, the slider slides to an alignment position where the slider aperture aligns with one of the pair of apertures in the cover such that the first prong slips though both the aperture and the slider aperture, and the second prong slips through a respective one of the pair of apertures bypassing the slider, wherein when an object is inserted into one of the apertures, the slider tilts and is prohibited by the upper rib formed on the interior surface of the cover from moving into the alignment position such that the object is prohibited from engagement with the receptacle terminal, and wherein when an object is inserted in a respective one of apertures, the slider tilts and is prohibited from moving into the alignment position by the lower rib formed on the top surface of the platform such that the object is prohibited from engagement with the receptacle terminal, and wherein the leaf spring biases the slider back into the misaligned position after the first and second prongs are removed from the pair of apertures.

9. The outlet according to claim 8 wherein the distance between said predetermined position and said alignment position is 0.375".

* * * * *